US010024640B2

(12) United States Patent
Engmann

(10) Patent No.: US 10,024,640 B2
(45) Date of Patent: Jul. 17, 2018

(54) CONTAINER FOR EXPLOSIVE MATERIAL

(71) Applicant: Plastpack Defence ApS, Hvidovre (DK)

(72) Inventor: Jan Bendix Engmann, Hvidovre (DK)

(73) Assignee: Plastpack Defence ApS, Hvidore (DK)

( * ) Notice: Subject to any disclaimer, the term of this patent is extended or adjusted under 35 U.S.C. 154(b) by 0 days.

(21) Appl. No.: 14/895,413

(22) PCT Filed: Aug. 28, 2014

(86) PCT No.: PCT/EP2014/068243
§ 371 (c)(1),
(2) Date: Dec. 2, 2015

(87) PCT Pub. No.: WO2015/028544
PCT Pub. Date: Mar. 5, 2015

(65) Prior Publication Data

US 2016/0116263 A1 Apr. 28, 2016

(30) Foreign Application Priority Data

Aug. 30, 2013 (DK) ..... PA 2013 70478

(51) Int. Cl.
*F42B 39/24* (2006.01)
*A45C 13/36* (2006.01)
(Continued)

(52) U.S. Cl.
CPC ..... *F42B 39/24* (2013.01); *A45C 13/36* (2013.01); *B65D 1/42* (2013.01); *B65D 81/054* (2013.01);
(Continued)

(58) Field of Classification Search
CPC ..... F42B 39/24; B65D 81/054; B65D 11/16; B65D 1/42; B65D 1/44; B65D 1/46;
(Continued)

(56) References Cited

U.S. PATENT DOCUMENTS 2,371,271 A 3/1945 Smith
3,403,713 A * 10/1968 Good ..... B65D 11/16 206/521
(Continued)

FOREIGN PATENT DOCUMENTS

AU 491402 B 6/1976
DE 2655721 A1 6/1978
(Continued)

OTHER PUBLICATIONS

International Search Report for PCT/EP2014/068243, dated Oct. 28, 2014, 2 pages.
(Continued)

*Primary Examiner* — Anthony Stashick
*Assistant Examiner* — Mollie Impink
(74) *Attorney, Agent, or Firm* — Ziegler IP Law Group, LLC

(57) ABSTRACT

A thermoplastic container for explosive material comprising: a primary part defining a rigid compartment for holding explosive material, where the primary part comprises: a side wall having an inner periphery defining the side boundaries of the compartment and an outer periphery, a base arranged at a lower end of the side wall defining the lower boundary of the compartment, where an upper end of the side wall is arranged to provide access to the compartment allowing explosive material to be loaded into the compartment; a secondary part comprising: at least one reinforcement element defining an outer periphery of the container, wherein the reinforcement element is coupled to the primary part and is adapted to provide horizontal and/or vertical load support to the primary part and where the reinforcement element comprises at least one collapsible impact zone adapted to absorb an external impact to the secondary part and to
(Continued)

transmit the excess forces of the impact into from the reinforcement element to the primary part.

13 Claims, 6 Drawing Sheets

(51) Int. Cl.

| | |
|---|---|
| ***B65D 81/05*** | (2006.01) |
| ***B65D 85/30*** | (2006.01) |
| ***B65D 1/42*** | (2006.01) |
| ***F42B 39/26*** | (2006.01) |
| ***F42B 39/18*** | (2006.01) |
| ***F42B 39/30*** | (2006.01) |

(52) U.S. Cl.
CPC ..... *B65D 85/30* (2013.01); *F42B 39/18* (2013.01); *F42B 39/26* (2013.01); *F42B 39/30* (2013.01); *B65D 2501/00* (2013.01); *B65D 2543/00101* (2013.01); *B65D 2543/00296* (2013.01)

(58) Field of Classification Search
CPC ..... B65D 85/30; B65D 85/302; A45C 13/36; F41C 33/048
See application file for complete search history.

(56) References Cited

U.S. PATENT DOCUMENTS

| | | | | |
|---|---|---|---|---|
| 3,593,873 | A | 7/1971 | Vonk | |
| 4,159,764 | A | 7/1979 | Schinke | |
| 4,523,692 | A * | 6/1985 | Lemkin | B65D 21/0219 206/508 |
| 5,720,403 | A * | 2/1998 | Sawyer | B65D 9/06 217/13 |
| 2004/0055922 | A1 | 3/2004 | Ordonez | |
| 2007/0175780 | A1 * | 8/2007 | Yukawa | B65D 1/24 206/308.3 |
| 2009/0152280 | A1 | 6/2009 | Luburic | |
| 2010/0077813 | A1 | 1/2010 | Zhang | |

FOREIGN PATENT DOCUMENTS

| | | | | |
|---|---|---|---|---|
| DE | 9311597 | U1 * | 9/1993 | B65D 1/42 |
| EP | 0047862 | A1 | 3/1982 | |
| EP | 0069419 | A1 | 1/1983 | |
| GB | 722347 | A | 1/1955 | |
| JP | 2011040324 | A | 2/2011 | |
| KR | 101425670 | B1 | 8/2014 | |
| KR | 20140005955 | U | 11/2014 | |
| NL | 9400776 | A | 12/1995 | |
| WO | 2007070029 | A1 | 6/2007 | |

OTHER PUBLICATIONS

Examination report No. 1; AU Application 2016228003; Oct. 20, 2017; 9 pages.
European Patent Office, Decision to Grant, Application No. 14756052.8, dated Sep. 14, 2017, 2 pages.

* cited by examiner

CONTAINER FOR EXPLOSIVE MATERIAL

FIELD OF THE INVENTION

Background

Explosive material, such as ammunition, detonators, munitions, dynamite, explosives etc. may be very useful in different situations. Explosives are often used in mining operations, ammunition is used in battlefields or for hunting purposes, and often has to be transported a long way from the manufacturer and to the location where the explosive material is to be used.

There are various requirements for the transport of explosive material, depending on the use of the material, the volatility of the material, the shelf life of the material and so on. For military ammunition, there are very strict guidelines on how ammunition is supposed to be handled, and there are various requirements for the transport containers for the ammunition, as the containers have to be capable of withstanding very hostile environments, and must be strong enough to protect the ammunition from exploding, should the container be dropped to a hard surface, such as the ground.

There are different requirements which an explosive material container has to fulfill, where different organisations, using the container may define the specific requirements which a specific container has to fulfill. The North Atlantic Treaty Organisation (NATO) has specific requirements to what kind of ammunition is used by its members, and has specified ammunition standards to which the member states and armies can adhere to. The purpose of such standards is that the ammunition is interchangeable, and a coalition of forces may use the same ammunition which can simplify logistics and storage requirements, as all the forces can use the same standard ammunition. This also means that NATO has also specific requirements for the containers which the NATO ammunition is to be transported and stored in. The ammunition containers have to have a specific size, both inside and outside, so that the container is easily recognizable as holding a specific type of ammunition, and have a specified outer dimension so that the ammunition containers may be easily be stacked on pallets for bulk transportation. An example of such standardized ammunition containers is the M19A1 ammunition box for 7.62×51 mm NATO cartridges. Other types of ammunition containers are used for other types of standard NATO ammunition, where the size of the container reflects the size of the ammunition.

In addition to the standardized size and design of the ammunition containers, the containers used for NATO ammunition are required to withstand the extreme environments, to which the ammunition containers are supposed to be in, such as extreme colds and extreme heat and must be able to hold the ammunition in storage for a minimum of 20 years. In all these conditions the ammunition container must be in working order, so that the ammunition may be transported and accessed without any hindrance.

The above requirements may be seen as the normal use requirements for a NATO ammunition container, where there are further requirements for the container that covers extraordinary situations, such as if the container is damaged. The container must be capable of withstanding shocks or impacts within a predetermined range, in order to ensure that the container maintains its mechanical structure for holding and transporting the ammunition in case the container is damaged. The predefined range of tolerance is for example that the container must be able to hold the ammunition, be carried via a handle, and be openable when a container filled with ammunition has been dropped from at height of 12 meters to a hard surface, such as concrete, in a cold environment of −47° C.

Such reliability of NATO ammunition containers has been achieved by providing the ammunition in containers that are made of steel, where the mechanical strength of the steel is not significantly affected by change in temperature, within a predetermined range from about −47° C. to 70° C., and is capable of being deployed in more cold and more heat should that be necessary. The steel casing of the container is also highly resistant to shocks or impacts, meaning that the structural integrity of the container is maintained even if the container is dropped from a significant height. The steel may bulge and be indented after the fall, but the steel construction is stable enough to allow the container to maintain its substantial shape, without falling apart, and containing the ammunition should such an accident happen. Furthermore, the steel container is of such a mechanical strength that it is capable of withstanding the stacking ammunition containers in large bulks on pallets for bulk transportation, where each bottom container in the stack may bear the weight of approximately 20 fully loaded ammunition containers.

However, even though steel ammunition containers have been used since the Second World War (1940s) and have served its purpose fully, the steel construction of an ammunition container has a number of drawbacks. A steel container that is capable of withstanding all the forces required by NATO is made of a steel material that is relatively thick, resulting in an ammunition container that has a relatively high weight compared to the weight of the ammunition. This means that if ammunition is to be transported in bulk to a distant location of deployment, the transport to its final destination is predominately done by air transport. Any form of air transport has a limit, where the load carrying capacity of the aircraft if often the limiting factor when the aircraft is being loaded. Thus, when ammunition is being transported in bulk, the weight of the ammunition containers may be between 5-15% of the total weight of the bulk transport of the ammunition. Thus, any reduction in weight of the ammunition container could save weight for the bulk transport, and a container weight reduction of approximately 50% could allow the aircraft to carry between 2.5-7.5% more ammunition in each transport run. Such reduction would reduce the logistics expenses by the military, as each kilogram of weight that has to be transported from one place to another has a cost.

Furthermore, even though the material cost of steel is currently relatively low, the assembly and construction of steel cases is relatively expensive, as the steel panels have to be formed into its shape and welded into its shape. This construction is time consuming, either for skilled metal workers or robots that are performing the construction and assembly operations.

Thus, there is a necessity to provide a container for explosives that is lightweight, inexpensive in production and is capable of meeting the minimum standards that are required for use within the NATO alliance.

GENERAL DESCRIPTION

In accordance with the invention, there is provided a thermoplastic container for explosive material comprising: a primary part defining a rigid compartment for holding explosive material, where the primary part comprises: a side wall having an inner periphery defining the side boundaries of the compartment and an outer periphery, a base arranged at a lower end of the side wall defining the lower boundary of the compartment, where an upper end of the side wall is arranged to provide access to the compartment allowing explosive material to be loaded into the compartment; a secondary part comprising: at least one reinforcement element defining an outer periphery of the container, wherein the reinforcement element is coupled to the primary part and is adapted to provide horizontal and/or vertical load support to the primary part and where the reinforcement element comprises at least one collapsible impact zone adapted to absorb an external impact to the secondary part and to transmit the excess forces of the impact into from the reinforcement element to the primary part wherein the container is provided with a top part, that is adapted to selectively prevent access to the compartment wherein the top part is provided with cooperative top reinforcement element that extends the reinforcement element of the secondary part, from a lower end of the top part to an upper end of the top part, providing at least one second collapsible impact zone and providing horizontal and/or vertical load support from the upper end of the top part and to the lower end of the top part.

By providing the reinforcement element, it is possible to construct a container for explosives made out of thermoplastic that is formed of a primary part that is, on its own, not capable of withstanding impacts or shocks that live up to the standard of NATO ammunition case standards. A problem with thermoplastic materials is that when force is applied to the thermoplastic material, if the force is high enough the deformation that occurs is in the form of irreversible plastic deformation that can seriously diminish the mechanical integrity of the material deformation. Furthermore, if the plastic is a rigid plastic, the deformation may be in the form of breakage of the material, where cracks, fractures, splinters, shattering or even complete disintegration can occur, especially in cold conditions as the rigidness prevents the thermoplastic material to deform beyond a certain level. Such problems may be solved in the simplest manner by increasing the thickness of the material, so that the impact may be absorbed by more material. Thus, the thickness of the material may be increased up to a point to where the thermoplastic material is capable of withstanding the required impact or shock. This method of solving the durability of the thermoplastic material means that the increase in material thickness results in an increased weight of the material, which means that the advantage of a constructing from a lightweight material has vanished.

Thus, an aspect of the present invention, is that the plastic container is provided with at least one area, in the form of a secondary part placed on the outside of the primary container with is specifically designed to give structural integrity to the primary part and furthermore to absorb an impact to the thermoplastic container. By providing a reinforcement part on certain parts of the container it is possible to reinforce the primary part in selective areas that are more likely than others to be the object of an impact or shock, without adding reinforcement material to the primary part in areas that are not likely to be affected by an impact or shock in general usage of the container.

The reinforcement element may be added to the outer surface of the primary part, in areas that are most likely to be the first point of contact when the box is dropped on a flat surface. Such exposed areas may e.g. be the corners and joining of side walls, should the container be of a rectangular shape, having four sides walls, a bottom wall and a top wall, where the side walls are joined and the bottom and top walls are joined to the side walls. The reinforcement element may be positioned to overlap the exposed area of the primary container, providing an impact zone, where the impact zone is adapted to be capable of withstanding the impact that would otherwise affect the exposed area. This means that when an impact is directed towards the exposed area, the impact reinforcement element becomes the first point of contact, and the impact zone absorbs the force of the impact and transmits the excess force (force not absorbed by the impact zone) to areas of the primary part that are distant from the exposed part, and thereby distributing the force of the impact to a much larger area of the primary part allowing the force to be absorbed in the primary part without risking a plastic deformation of the primary part. Thus, reducing the risk that the energy of the impact will be concentrated in a small concentrated area of the outer periphery of the primary part.

The impact zone of the reinforcement element, which is adapted to protect the exposed area of the primary part, may be adapted to absorb the impact by allowing parts of, or the entire impact zone to deform should the impact be of a force that is above a predefined amount. Thus, at least a part of the kinetic energy transferred via the impact is absorbed by the impact zone causing a deformation of the impact zone, while any excess kinetic energy, not absorbed by the deformation, may be transferred away from the exposed area of the primary part. Thus, by providing a reinforcement element that is capable of deforming and transferring the kinetic energy away from the exposed area, it is ensured that the exposed area is protected by the reinforcement element and ensuring that the exposed area of the primary part will not rupture when during an impact. Thus, it is ensured that the contents of the container will remain inside the container, and will not be capable of exiting the container via the area of the container which has suffered the impact. This effectively means that the container may be provided with impact zones that are designed to deform in a controlled manner, ensuring that the deformation does not damage holding compartment of the container and ensuring that the content holding function of the container is intact.

Furthermore, as only selective exposed areas of the container are provided with reinforcement elements, and not all the outer surfaces of the primary part, it is possible to provide a container for explosive material that is lightweight. Thus, areas that are not likely to be affected by an impact, e.g. when the container is dropped onto a flat surface, may have a reduced material thickness and/or density, while exposed areas of the container may be provided with protective zones. Thus, the container in accordance with the invention may be provided in lightweight thermoplastic material, where vulnerable areas of the container may be provided with one or more area that is reinforced to withstand an impact.

In one embodiment the reinforcement element may be adapted to provide horizontal and/or vertical load support to the primary part. The primary part may be of a thermoplastic material, which may have a predefined compressive strength, allowing the primary part to withstand a certain load. However, for an ammunition container adapted to withstand the rigorous NATO standards must be capable of carrying a load that is up to 20 times its own loaded weight (filled with ammunition) and where the container must be capable of carrying the load for approximately 20 years in storage. The thermoplastic material may be chosen as an alternative to steel as a lightweight material, it is advantageous to provide horizontal and/or vertical load support to the primary part in at least the one area where the reinforcement member is provided. Thus it is possible to add load support to the inner part in discrete areas, and thereby ensuring that the primary part is prevented from collapsing under the load when up to 20 times the weight of the loaded container is stacked on top of the container. This ensures that the container may be stored and transported in bulk, where a number of containers are stacked onto a pallet, to make bulk transport easier.

In one embodiment the reinforcement element may extend from the lower end of the side wall to the upper end of the side wall. The reinforcement element may be provided at least one part of the side wall of the primary part, and where the reinforcement element provides a load support to the primary part along the entire height of the side wall and/or where the reinforcement element provides a protection to an area on the outer periphery that extends the entire horizontal length (height) of the side wall. This means that the side wall, in the area of the reinforcement element, will be capable of bearing an increased load compared to an area of side wall that does not have a reinforcement element. Alternatively, the reinforcement element can be provided in such a manner that the reinforcement element off loads a part of the horizontal and/or vertical load applied to the top of the container, so that the horizontal and/or vertical load is distributed between the side wall of the primary part and the reinforcement element. Alternatively, the reinforcement element may both provide an increased load support to the side wall and offload the side wall, i.e. in combination.

As the reinforcement element may extend along at least the entire horizontal length of the side wall, the reinforcement element may protect an exposed area of the side wall along the entire height of the side wall. Such an area may, as an example be a bend along the side wall, where the side wall on one side of the bend is substantially perpendicular to the side wall on the opposite side of the side wall. I.e. in a corner area of the primary part, as the corner is an exposed area of the primary part. Thus, the reinforcement element may overlap the outer corner area of the primary part, so if the an impact is directed towards the corner area, the reinforcement area will receive the impact, and ensure that the energy is absorbed in the impact zone and/or directed towards another area of the primary part.

In one embodiment the first end of the reinforcement element may be attached to a first area of the primary part and a second end of the reinforcement element is attached to a second area of the primary part that is distant to the first area along the length of the side wall of the primary part. This means that the reinforcement element may be coupled in two different positions to the primary part, so that when the reinforcement element is exposed to an impact directed towards an exposed area of the primary part, the reinforcement element will transmit the energy of the impact to at least two different positions on the primary part, and thereby minimizing the risk that the primary part will be compromised or opened via the exposed area, ensuring that the content of the primary part will remain inside the primary part subsequent to the impact and will not escape via an impact damage to the exposed part. By attaching the reinforcement element in two different positions, the kinetic energy of an impact will be distributed to a larger area of the primary part than if the reinforcement element is only attached in a single position.

Within the meaning of the present invention, the length of the side wall of the primary part may be seen as the circumference of the side wall when the side wall is seen from above or below. The circumference may be measured along the length of the side walls, where the length is vertical and is perpendicular to the horizontal height of the side wall, and the direction of thickness of the side wall.

In one embodiment, the first area of the primary part may be arranged on an end side wall of the primary part and the second area of the primary part is arranged on a longitudinal side wall of the primary part. This means that the reinforcement element may extend from an end side wall and across a corner of the primary part to a longitudinal side wall, ensuring that the reinforcement element overlaps the entire corner of the primary part across the length of the side wall. Thus the exposed part, i.e. the corner, which may be an exposed part of the primary part is protected by the reinforcement element, ensuring that any impact that is directed towards the overlapped corner is received by the reinforcement element. Furthermore, in case the reinforcement element is exposed to an impact, the kinetic energy of the impact is transferred to two different areas of the side wall, and where the reinforcement element transfers the energy in at least two different directions, when the end side wall and the longitudinal side wall are at an angle to one another, such as if the side walls are substantially perpendicular to each other. Thus, the energy of the impact is distributed to two different parts of the primary part, and thereby reducing the risk that the constructional integrity of the primary part is compromised.

In one embodiment, the collapsible impact zone of the reinforcement element may be elevated away from outer periphery of the side wall, so that an overlapping area of the impact zone is mechanically independent from an exposed area of the outer periphery. The direction of elevation may be substantially normal to the outer periphery of the primary part, so that there is a distance between the reinforcement element and the exposed area of the primary part. Thus, if the impact zone is exposed to an impact, there is a reduced risk that the reinforcement element will transfer the energy of the impact into the exposed area in a direction that is normal to the outer periphery. The reinforcement element will transfer the kinetic energy of the impact to a different area of the primary part, reducing the risk that the energy of the impact will be concentrated in a small concentrated area of the outer periphery of the primary part.

In one embodiment, the collapsible impact zone may be arranged to overlap a transitional area of the side wall where a longitudinal side wall joins an end side wall, where the longitudinal side wall joins the base of the primary part and/or where the base wall joins the end side wall. Thus, the impact zone of the reinforcement element may be arranged on the outer periphery of the primary part in such a manner that a transitional area, such as a corner joining two or three sides of a primary part is covered by an impact zone. The transitional areas, or corners, of a rectangular primary part are the areas that are have the most risk of being exposed to an impact, as it is highly unlikely that a container will be dropped onto a flat surface, where the plane of a side wall, bottom wall or a top wall will be 100% parallel to the flat surface. Thus, a transitional area may be seen as the part of the primary part that is most likely to be exposed to an impact. Thus, by ensuring that an exposed area of the primary part is overlapped with a reinforcement element, and thereby having an impact zone that is adapted to absorb and transfer the energy of the impact away from the exposed area, reduces the risk that the exposed part will be damaged after the impact.

In one embodiment, the upper end of the side wall may be provided with a flange extending along the upper end of the side wall. The upper end of the side wall may be provided with a flange that extends along the entire upper area of the side wall, extending an opening into the container above the limit of the side wall. The flange may be of the same material as the side wall, having the same thickness and the same shape, where the flange may be adapted be received in a top part, or a lid, that is adapted to close the compartment from the outside. Thus the flange may be adapted to provide an edge to which a sealing in the top part will cooperate with, so that the lid may be sealed hermetically and/or liquid tight to the primary part.

In one embodiment, the container may be provided with a top part that is adapted to selectively prevent access to the compartment. The top part may be seen as a lid onto the container, so that the container may be closed during transport and/or storage. The lid ensures that external elements, such as dirt do not enter the compartment when the lid is closed, and also ensures that the contents of the compartment are securely maintained inside the compartment while the top part is secured to the primary part or the container.

In one embodiment, the top part may have a groove that cooperates with the flange of the side wall. The groove may be positioned and sized in such a way that when the top part is closed, the bottom of the groove is substantially flushed with a top of the flange. In one embodiment, the entire bottom of the groove can be flushed with the entire top of the flange, ensuring that the closure is even along the entire groove.

In one embodiment, the groove may be provided with a sealing element. The sealing element may be arranged to minimize the risk that liquids, vapour, dirt particles or gasses may enter the compartment, when the top part is closed. The sealing may have a further functionality, in that the sealing may be provided between inner surface of the lid and the top surface of the flange. Thus, if the lid is exposed to an impact, the sealing may be adapted to absorb a part of the kinetic energy of the impact, reducing the risk that the kinetic energy will damage the flange and/or the side wall of the primary part. Such a sealing may be an elastic seal that is capable of absorbing kinetic energy, e.g. a rubber seal, where the thickness of the sealing has an impact on its absorbing capabilities.

In one embodiment the top part may be provided with a handle. The handle may be used by a person to transport the container from a first position to a second position using the hand.

In one embodiment the top part may be provided with a handle that is offset in its parked position from an upper edge of the top part in a direction towards the compartment of the container. This ensures that if the container is dropped on a flat surface, the handle will not be an initial point of contact of the impact, reducing the risk that the handle will be damaged during the impact. This increases the likelihood that the handle may be used to carry the container away after an impact has damaged the container, and where the handle is securely fastened to the top part.

In one embodiment, the top part may be provided with cooperative top reinforcement element that extends the reinforcement element of the secondary part, from a lower end of the top part to an upper end of the top part, providing at least one second collapsible impact zone and providing horizontal and/or vertical load support from the upper end of the top part and to the lower end of the top part. The top part of the container may have a size and a shape that corresponds with the primary part, i.e. for a rectangular compartment, the shape of the top part will most likely be rectangular as well. Thus, the top part is provided with corners or junctions between side parts and/or the top wall of the top part, which may be seen as exposed parts of the top part. Thus, in order to ensure that the exposed areas of the top part that are likely to be the initial point of contact when the closed container is dropped, may be provided with reinforcement elements to absorb the energy of the impact and to transmit the kinetic energy of the impact to a different part of the top part, thereby reducing the risk that the impact will damage the top part in such a way that the constructional integrity of the top part is significantly compromised.

The reinforcement element on the top part may be constructed in similar or the same ways as the reinforcement element of the primary part, and any feature and/or advantage of one of the reinforcement elements may be equally applied to the other.

Furthermore, the top reinforcement element may be used to transfer a load support from the lid and towards the reinforcement element and/or the side wall and thereby increasing the load bearing capabilities of the top part and the side walls, ensuring that the closed container is capable of carrying a load that is up to 20 times its own loaded weight (filled with ammunition) and where the is capable of carrying the load for approximately 20 years in storage.

In one embodiment, the container may be provided with a plurality of reinforcement elements of the secondary part that are elevated from the outer peripheries of the primary part, increasing the likelihood that the secondary part is the initial point of contact when the container comes into contact with a flat surface. The reinforcement elements may have an outer circumference that is greater than the outer circumference of the primary part, so that the impact is firstly exposed to the reinforcement element, allowing the energy of the impact to be absorbed and transferred to a different part of the primary part. The reinforcement elements may be provided at the peripheries of the walls of the container and/or the top part, so ensuring that the initial energy of the impact is transferred from the surface and to the reinforcement element.

In one embodiment the reinforcement element may extend from the upper end of the side wall and towards the lower end of the side wall and terminating before it reaches the lower end of the side wall In one embodiment the side wall may be provided with a reinforcement beam that extends from a lower end of the reinforcement element to the lower end of the side wall.

In one embodiment the base may be provided with a plurality diagonal reinforcement beams.

In one embodiment the reinforcement element may be provided with a handle.

In one embodiment the reinforcement element may define a volume between the side boundary of the compartment and an inner boundary of the reinforcement element The container according to the invention, may be produced of a thermoplastic material, that allows the container to be injection and/or blow moulded, ensuring that the container may be produced at a low cost.

The container according to the invention, even though it is primarily disclosed for use with military ammunition, may be used as a container for any kind of explosive material that has to be transported and needs to be protected during transport and/or during storage.

The primary part and the secondary part may be at least partly constructed from thermoplastic materials. In another embodiment, the primary part and/or the secondary part may be entirely constructed from thermoplastic materials.

BRIEF DESCRIPTION OF DRAWINGS

The invention is explained in detail below with reference to the drawings, in which.

In the following detailed description of the figures, reference numbers relating to similar parts or elements will be utilized for the same parts or elements in all the embodiments shown unless otherwise stated.

DETAILED DESCRIPTION OF DRAWINGS

Figure 1:
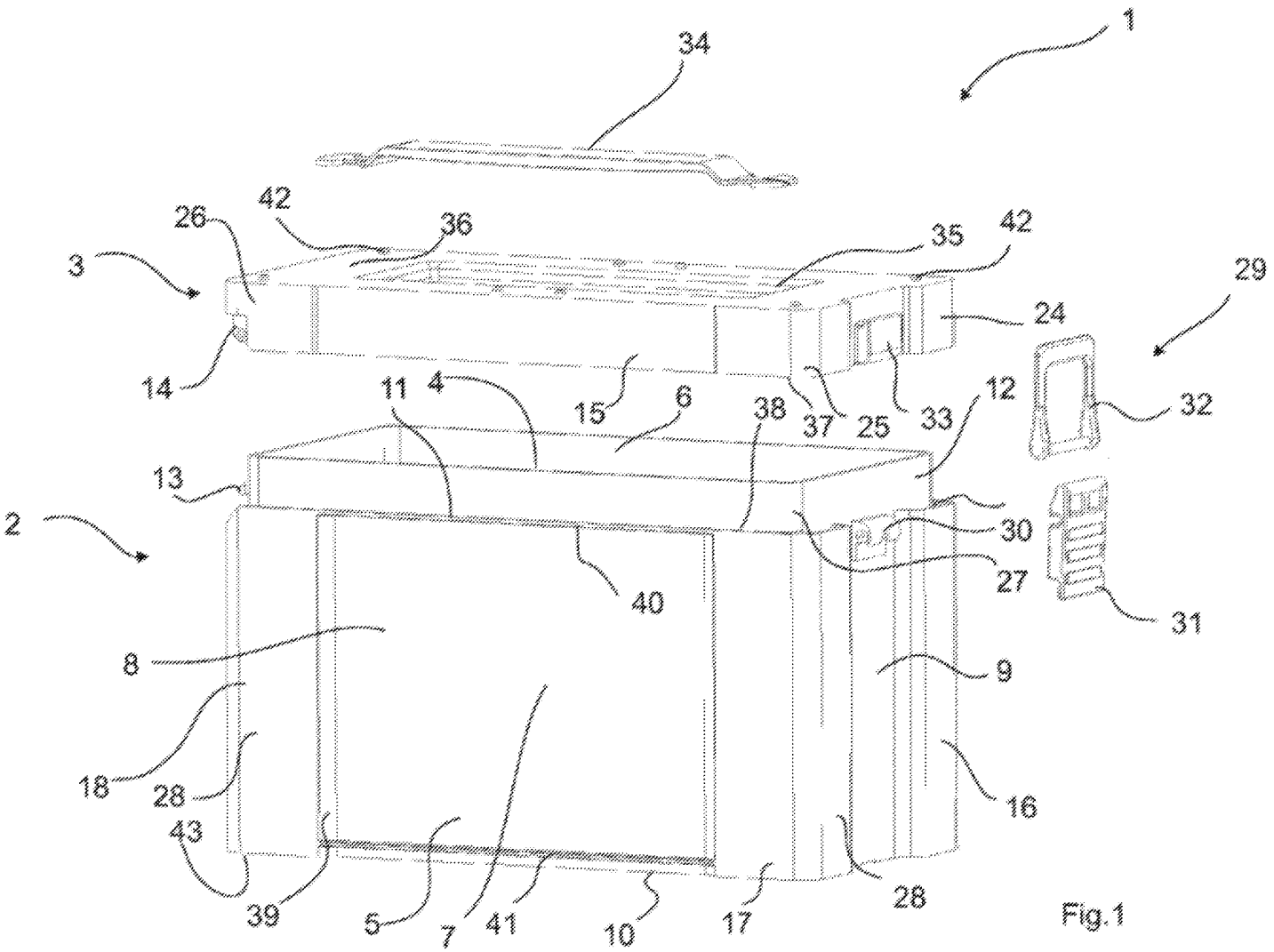
FIG. 1 shows an exploded perspective view of a container in accordance with the invention.

FIG. 1 shows a container 1 in accordance with the invention, where the container 1 comprises a casing part 2 and a lid part 3. The lid part 3 is adapted to close the casing part 2, in order to enclose the compartment 4 of the casing part 2.

Figure 3:
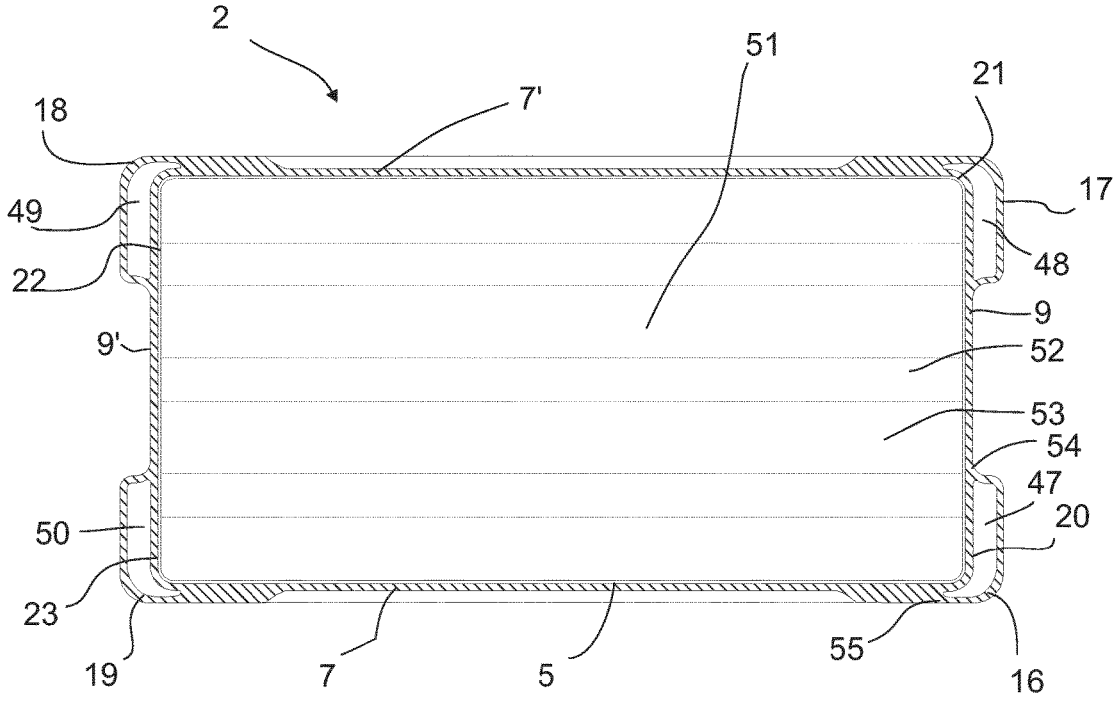
FIG. 3 shows a cross sectional view of the casing part of FIG. 2 taken along axis III-III.

The casing part 2 comprises a primary part 5, which has an inner periphery 6 that defines the compartment 4 of the casing part 2, and an outer periphery that defines an outer periphery 7 of the compartment 4. In this exemplary embodiment the compartment is shown as substantially rectangular. The primary part 5 comprises a side wall that may extend to four sides of the wall in a longitudinal side wall 8 and an end side wall 9, where the longitudinal and the end side walls have opposing end walls (not shown). The side walls have a lower edge 10 defining a bottom part of the compartment 4 and an upper edge 11 defining the upper part of the compartment 4, where the height of the side wall defines the loading volume of the compartment 4. The side walls 8, 9 are provided with a flange 12 that extends along the upper edge 11 of the compartment 4, where the upper edge is designed to embed into the lid part 3, when the lid part is closed, as seen in FIG. 3. The upper part may further have a first part 13 of a hinge, where the second part 14 is attached to the lid part 3. The hinge 13, 14 ensures that the lid may be rotated along an axis defined by the hinge, in order to open and close the lid part 3 onto the casing part 2 of the container 1.

Thus, when the lid is closed, the flange 12 is inserted into the volume of the lid part 3, so that the side wall 15 of the lid part 3 overlaps the flange 12 so that the flange 12 is hidden from view when the lid is closed.

The primary part 5 of the casing part 2 of this embodiment is provided with at least four reinforcement elements 16, 17, 18, 19 that are arranged on the outer periphery 7 of the primary part 5. The reinforcement elements 16, 17,18,19 are arranged to overlap the exposed parts, e.g. the corners (20, 21, 22, 23 as shown in FIG. 3) of the primary part 5, so that if an impact is directed towards the exposed parts of the primary part 5, the reinforcement elements 16, 17, 18, 19 will intersect the impact before the energy of the impact can come into contact with the exposed areas. The reinforcement elements 16, 17, 18, 19 may be designed as weakened areas that are designed to collapse or break, in order to absorb an impact that is directed towards the exposed areas. Thus the reinforcement elements 16, 17,18, 19 are capable of absorbing any impact that may be applied to the primary part 5, and minimize the risk that the exposed areas, that define the outer periphery of the compartment 5, are damaged by the impact.

The lid part 3 may be provided with corresponding reinforcement elements 24, 25, 26 are adapted to protect the corners 27 of the flange, and to increase the strength of the lid part 3. The reinforcement elements are capable of absorbing any impact that may be applied to the lid part, minimizing the risk that the flange 12 is damage and/or that the structural integrity of the lid part 3 is compromised, so that the lid will remain in a closed state on the container if an impact is directed towards the lid part.

The reinforcement elements 16, 17, 18, 19 may also be function as an element providing horizontal and/or vertical load bearing capabilities to the primary part 5, so that when a load is applied to the primary part, via the lid part 3 or the flange part 12, the primary part will be able to withstand the load and reducing the risk that the structural integrity side walls 8,9 of the primary part will be compromised, causing the side wall 8,9 to collapse or be damaged by the load. The reinforcement elements 16, 17, 18, 19 may be used to offload a part of the load from the side walls of the primary parts and/or by providing extra strength to the primary part, and improving the rigidity of the side wall, e.g. to prevent the side wall from bulging from its original shape when a load is applied to the primary part. As the flange 12 of the primary part is adapted to be inserted into the lid part 3, providing a seal between the lid part and the flange, any load that is applied to the lid part 3, e.g. during stacking of multiple containers 1, may be transferred into the flange part and onwards towards the side walls 8,9 of the primary part 5. In order to increase the load bearing capabilities of the container, when the lid part 3 closes the compartment 6, the lower edge 37 of the reinforcement elements 24, 25, 26 of the lid part may be adapted to abut an upper edge 38 of the reinforcement elements 16, 17, 18, 19 of the primary part 5. This means that when a load and/or an impact is applied to the lid part 3, the energy of the load or impact may be transferred from the lid part 3 to the reinforcement elements 16, 17, 18, 19 of the primary part, ensuring that the energy is transferred between the two parts 2, 3, and thereby reducing the risk that the energy will be concentrated enough in a small area causing the container 1 to be compromised.

The reinforcement elements 16, 17, 18, 19 are applied to the outer periphery of the primary part 5, which means that in the areas where the reinforcement elements areas are provided, the total thickness of the wall is larger than the thickness of the side walls 8,9 having no reinforcement elements. This means that the outer surface 28 of the reinforcement elements 16, 17, 18, 19 is the outermost periphery of the primary part, ensuring when the container 1 is dropped on a flat surface, the initial point of contact with the flat surface is the reinforcement element. Thus, it is prevented that when dropped, the impact will damage the non-reinforced parts of the primary part 5, i.e. the recessed parts of the outer periphery of the casing.

The lid part 3 and the casing part 2 are provided with means for locking the lid part 3 in its closed position on the casing part 2. The means may be in the form of a latching mechanism 29, which is adapted to be attached to a fastener 30 on the end side wall 9 of the primary part. The latching mechanism 29 may be in the form of a draw latch 31, having a loop 32 that is adapted to interact with a fastener 33 on the lid part 3. The draw latch 31 may be closed, so that the loop holds the lid part tightly attached to the casing part, where the hinge 13, 14 holds the opposite end of the lid part 3 in contact with the casing part 2. The draw latch 31, loop 32, and the fasteners 30, 33, may be made of a thermoplastic material. By positioning the latching mechanism 29 may be positioned in the recessed part of the casing part 3, so that the outermost part of the latching mechanism does not extend beyond the outer surface 28 of the reinforcement part, ensuring that any impact with a flat surface will have its initial contact with the reinforcement element, and thereby protecting the latching mechanism.

Furthermore, the lid part 3 may be provided with a handle 34, where the handle, similar to the latching mechanism 29, is arranged in its parked position in an area 35 that is recessed in relation to the top surface 36 of the lid part 3. Thus, if the container 1 is dropped on the lid part 3, the handle will not be the initial contact of the impact, ensuring that the handle is intact when retrieving the container 1 after the impact.

Figure 2:
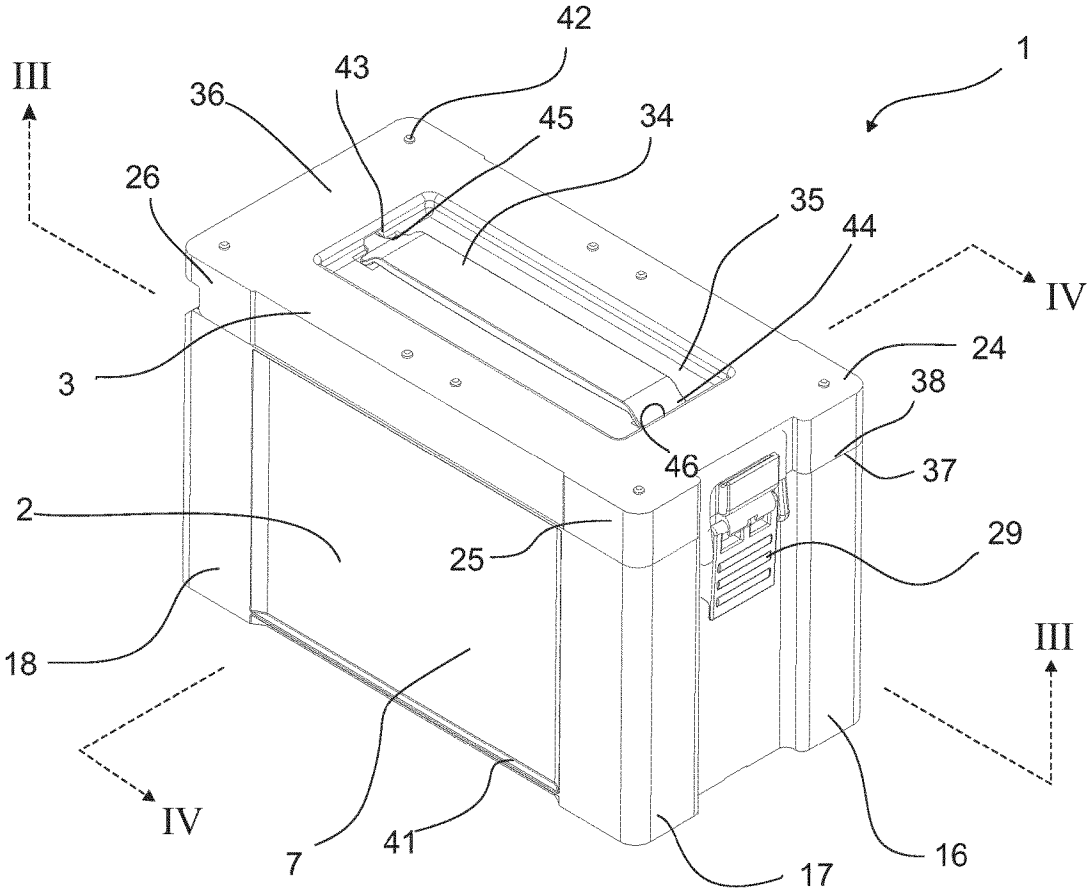
FIG. 2 shows a perspective view of a closed container in accordance with the invention.

The positioning of the handle 34 and the latching mechanism 29 in their recessed areas is shown in FIG. 2.

When an impact hits the container 1, having the reinforcement elements 16, 17, 18, 19, 24, 25, 26 as the initial point of contact, the reinforcement elements may be adapted to collapse in a controlled manner, so that the a part of the kinetic energy of the impact is absorbed by the collapse. The remaining part of the kinetic energy may be transmitted to other parts of the primary part, ensuring that the energy is distributed to a large area and reducing the risk of damage to the primary part 5. In this example the reinforcement element 18 is attached to the longitudinal side wall 7 of the primary part 5, via a transitional area 39. Thus when an impact reaches the outer surface 28 of the reinforcement element 18, the kinetic energy is absorbed by the reinforcement element and transmitted via the transitional area 39 to the longitudinal side wall 7 of the primary part 5. As the transitional area 39 extends from the upper edge 11 of the side wall towards the lower edge 10 of the side wall, the energy may be transferred to a large area or volume of the primary part 5. Furthermore, the primary part may be provided with reinforcement beams 40, 41 that extend along the longitudinal length of the side wall 7, which are in mechanical communication with the reinforcement elements of the primary part 5. The reinforcement beams 40, 41 allow the kinetic energy to be transmitted to other parts of the primary part 5, allowing the kinetic energy to be transmitted to an even larger area of the primary part. The reinforcement beams 40, 41 may also be used to provide strength to the side wall 7 in a direction that is parallel to the reinforcement beam, and reducing the risk of the side wall 7 collapsing in the longitudinal direction.

The top surface 36 of the lid may be provided with a plurality of plugs 42, that extend beyond the top surface of the lid, where the plugs may be adapted to interact with a plurality of cooperating sockets (not shown) that are positioned on the bottom surface of the casing part. Thus, when a container 1 is positioned on top of another container, the plug 42 and sockets will line up and connect, increasing the lateral stability of the stack, as the plugs 42 and sockets ensure that the two containers cannot displace sideward with regards to one another. The plugs may also be positioned in such a way, that one container may be positioned on top of two containers that are positioned approximately perpendicular to the upper container, allowing a crossed stacking of the containers and ensuring that the plugs are lined up with the sockets of the corresponding container.

For a crossed stacking it may be advantageous that the proportional size of the container is approximately 2:1 where the length of the container is approximately two times the width of the container. This allows two containers to be cross stacked on top of a single container where the half of the length of the upper container overlaps the width of the lower container, or vice versa.

FIG. 2 shows the container in accordance with the invention where the lid part 3 and the casing part 2 have been assembled. Furthermore, the handle 34 and the latching mechanism 29 have been introduced onto the container 1. The reference numerals shown in FIG. 1 may be applied to FIG. 2.

The lid part 3 has been introduced to close the compartment 4, where the lower edge 37 of the reinforcement elements 24, 25, 26 abuts the upper edge of the reinforcement elements 16,17,18,19, creating a mechanical connection between the reinforcement elements of the lid part 3 and the casing part 2, allowing kinetic energy to be transmitted from the lid part 3 and into the casing part 2.

The handle 34 may be seen as being in it parked position within the circumference outermost surface 36 of the top part 3. When the handle 34 is grabbed, the ends 43, 44 of the handle 34 allow the handle 34 to extend upwards and extending out of the recess 35 so that the handle may be accessed, similar to the handle of a wine box. The ends are loosely attached to the lid part, and have a margin of movement, allowing the length of the handle 34 between the handle sockets 45, 46 to become longer. When the handle is released, it may return to its parked position, inside the recess 35, due to e.g. the mechanical memory of the handle. I.e. any deformation to the material during the grabbing of the handle 34 may be reversible. The handle 34 may be made out of rubber, or any thermoplastic material.

FIG. 3 shows a cross sectional diagram taken along axis III-Ill of FIG. 2, where the casing part 2 is seen from above. The side walls 7 7', 9, 9' of the primary part 5, are joined or are transitioned in corner sections, 20, 21, 22, 23, that may be seen as exposed parts of the primary part 5. The exposed areas may be seen as the areas that have a high risk of being exposed to impact, when the container 1 is dropped onto a flat surface. Thus the corner areas 20, 21, 22, 23 and parts of the side walls 7, 7', 9, 9' are provided with reinforcement members 16, 17, 18, 19, that prevent the impact in coming into direct contact with the corner areas. This may be done in different ways, i.e. by introducing an increased material thickness in the exposed areas, but in this example, the reinforcement members are elevated in a direction away from the corner areas. This means that the corners are surrounded by open space 47, 48, 49, 50, which allows the reinforcement members to collapse and/or crumble in a controlled manner, without the reinforcement member coming into direct contact with the corner area.

Thus, the reinforcement member may absorb part of the impact, and as the reinforcement members are attached at a first 54 and a second end 55, in this view, to the primary part 5, the kinetic energy of the impact may be transferred from the reinforcement element 16, 17, 18, 19 and to the side walls 7, 7', 9, 9' of the primary part 5, ensuring that the kinetic energy is distributed to different parts of the primary part 5.

Figure 4:
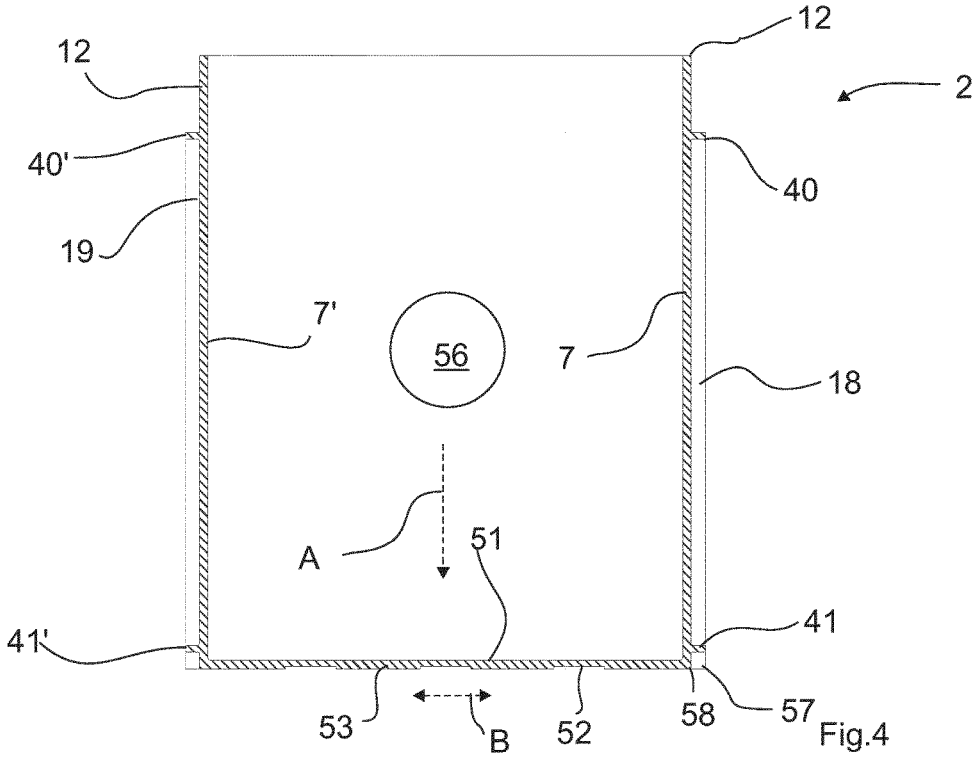
FIG. 4 shows a cross sectional view of the casing part of FIG. 2 container taken along axis IV-IV.

FIG. 3 further shows the bottom wall 51 of the container of the casing part 2, where the bottom wall may be provided with one or more absorption zones 52 where the bottom part has been weakened, as shown in FIG. 4. These zones 52 may have a material thickness that is less than the abutting zones 53, so that if a container filled with a mass in form of explosive material, such as ammunition, is dropped the absorption zones 52 are adapted to deform, by stretching or extending, so that the impact of the mass will be absorbed by the absorption zones 52. Thus, the abutting zones 53 will maintain their mechanical structure, while the absorption zones are allowed to deform in a controlled manner. The thickness of the material depends on the material properties, such as elasticity, density, etc. but the a correct thickness of the absorption zone 52 and the abutting zone 53 may be chosen based on the mass of the material that is supposed to be loaded into the container 1. The absorption zones may alternatively be made out of a different material than the abutting zones to allow controlled deformation of the zones.

FIG. 4 shows a cross sectional view of the casing part 2, taken along axis IV-IV of FIG. 2, where the reference numbers of the previous Figs. applies to FIG. 4. The bottom wall 51 of the casing part 2, may here be seen as having areas that have a reduced thickness, or absorption zones 52, compared to the abutting zones 53. This means that when a mass 56 is travelling in a downwards direction A, the absorption zones are capable of absorbing the kinetic energy of the mass 56 by stretching laterally in the directions of arrow B, where the thicker areas may maintain their shape and/or mechanical integrity, and ensuring that the mass is not capable of exiting compartment 4 via the bottom wall, when the impact is within the tolerated standards.

Furthermore, it may be seen in FIG. 4, that if the reinforcement element 18 has a height that corresponds with the height of the side wall 7, the bottom corner 57 of the reinforcement element is capable will receive any impact that is directed toward the bottom corner 58 of the side wall 7. Thus the reinforcement elements 16,17,18,19 ensure that an impact from a flat surface will always come into contact with the reinforcement element first and not the exposed areas of the primary part. In this view, the lid has not been placed on the flange 12, so that the flange is exposed. However, during use, when the container 1 is supposed to carry explosive material, the lid will be closed, and the flange 12 will not be exposed to an impact.

Figure 5:
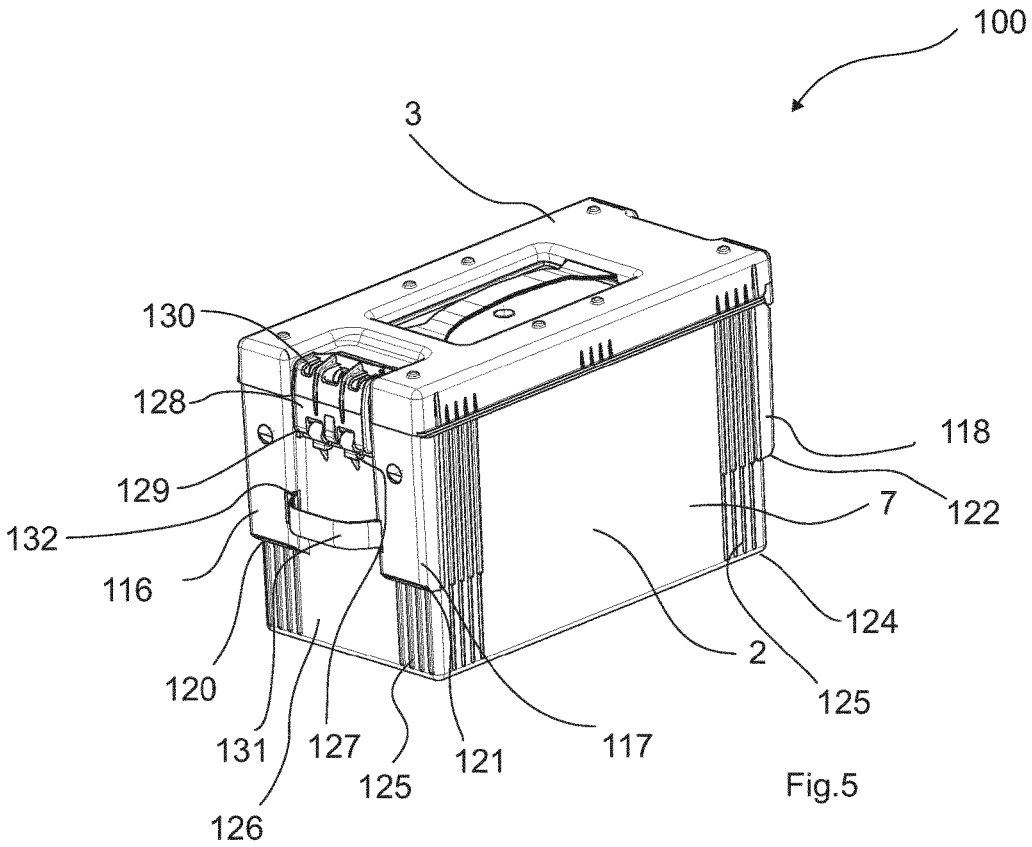
FIG. 5 is a perspective view of an alternative embodiment of a container in accordance with the invention shown from the front.

FIG. 5 is a perspective view of an alternative embodiment of a container 100 having a casing part 2 and a top part 3. The casing part 2 comprises a primary part (not shown) which has an inner periphery that defines the compartment of the casing part and an outer periphery 7 of the compartment, similar to that shown in the embodiment shown in FIGS. 1 and 2.

The container 100 differs though from the container 1 shown in FIG. 1 in that the reinforcement elements 116, 117, 118 overlap the corners of the casing 2, and extend from the top where the reinforcement elements 116, 117, 118 having the impact zones abut the top part and downwards where the lower parts 120, 121, 122 of the reinforcement elements 116, 117, 118 terminates before it reaches the vertical end 124 of the casing 2. The area of the casing below the reinforcement elements 116, 117, 118, between the lower parts and the vertical end of the casing, may be provided with reinforcement means 125, e.g. in the form of reinforcement beams 125, that provide the parts of the casing 2 that is not provided with a reinforcement element with an increased rigidity both in horizontal and vertical directions. Thus when the container 100 may be stacked, the reinforcement beams may transfer vertical forces downwards from the reinforcement elements and prevent the casing from being compromised when a significant load is placed on top of the container 100 during stacking. Furthermore, the reinforcement beams may provide a horizontal reinforcement, so that the contents casing 2 is prevented from bulging out when it is filled with e.g. ammunition or when a load is positioned onto the top part during stacking, or even when the users use the container for sitting. Thus the reinforcement beams 125 and the reinforcement elements 116, 117, 118 may collectively transmit loads from the top of the container 100 towards the bottom of the container, reducing the risk that the primary part may be compromised during its normal use.

The reinforcement elements 116, 117, and 118, in the areas covering the front end 126 and the back end 150 (shown in FIG. 6) may be hollow, i.e. where the reinforcement elements 116, 117, 118, create a volume between the outer periphery 7 of the casing 2 and an inner surface of the reinforcement elements 116, 117, 118, similar to the volumes 47, 48, 49, 50 shown in FIG. 3. The reinforcement elements may be open in the upper boundary, allowing a first latching mechanism 127 to be introduced into the volume and extend from one reinforcement element 116 to the opposite reinforcement element 117. The first latching mechanism 127 provides a base for a clasp 128, which may be rotationally coupled to the first latching mechanism at a first end 129, so that the clasp 128 may be moved from a closed position where the second end 130 of the clasp 128 is coupled to the top part 3, and fixes the top part 3 in a position where the top part prevents access to the compartment of the casing part 2, to an open position, where the second end 130 of the clasp 128 is moved away from the top part, allowing the top part 3 to be released from the casing part 2.

Furthermore, the volume of the reinforcement elements may further be utilized to fix a front handle 131 to the casing part 2, where the front handle 131 extends from within the volume of one of the reinforcement element 116 and across the first end 129 horizontally and into the volume of the opposite reinforcement element 117. The reinforcement element may be provided with an opening 132 that allows the front handle 131 to exit from the volume, where the opening 132 may be dimensioned to be smaller than an end part of the front handle 131, so that the end part is prevented from exiting the opening in a horizontal direction when a force is applied to the front handle 131.

Figure 6:
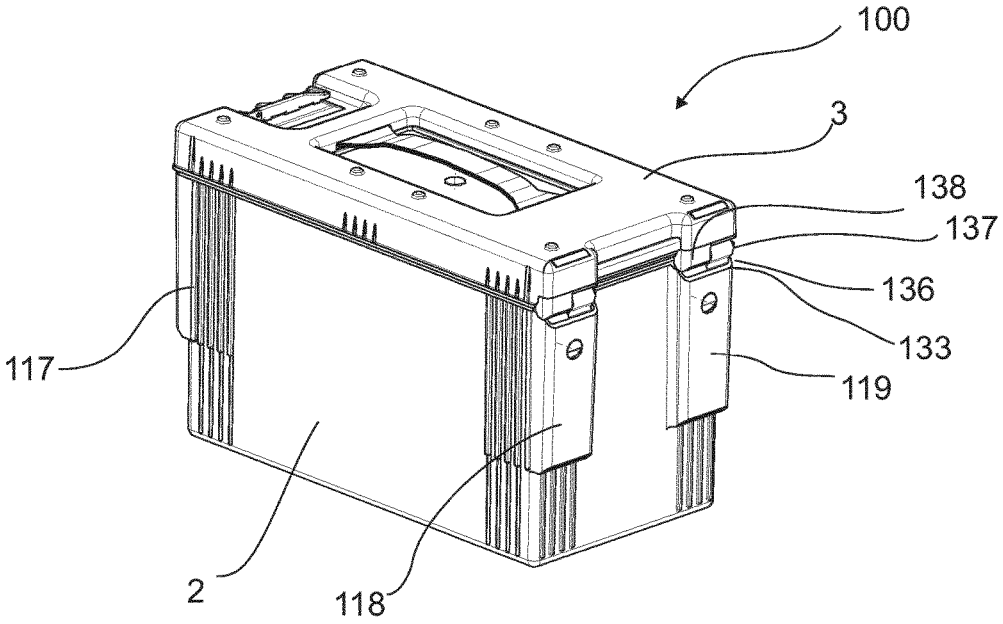
FIG. 6 is a perspective view of the container shown in FIG. 5 shown from the back.
Figure 7:
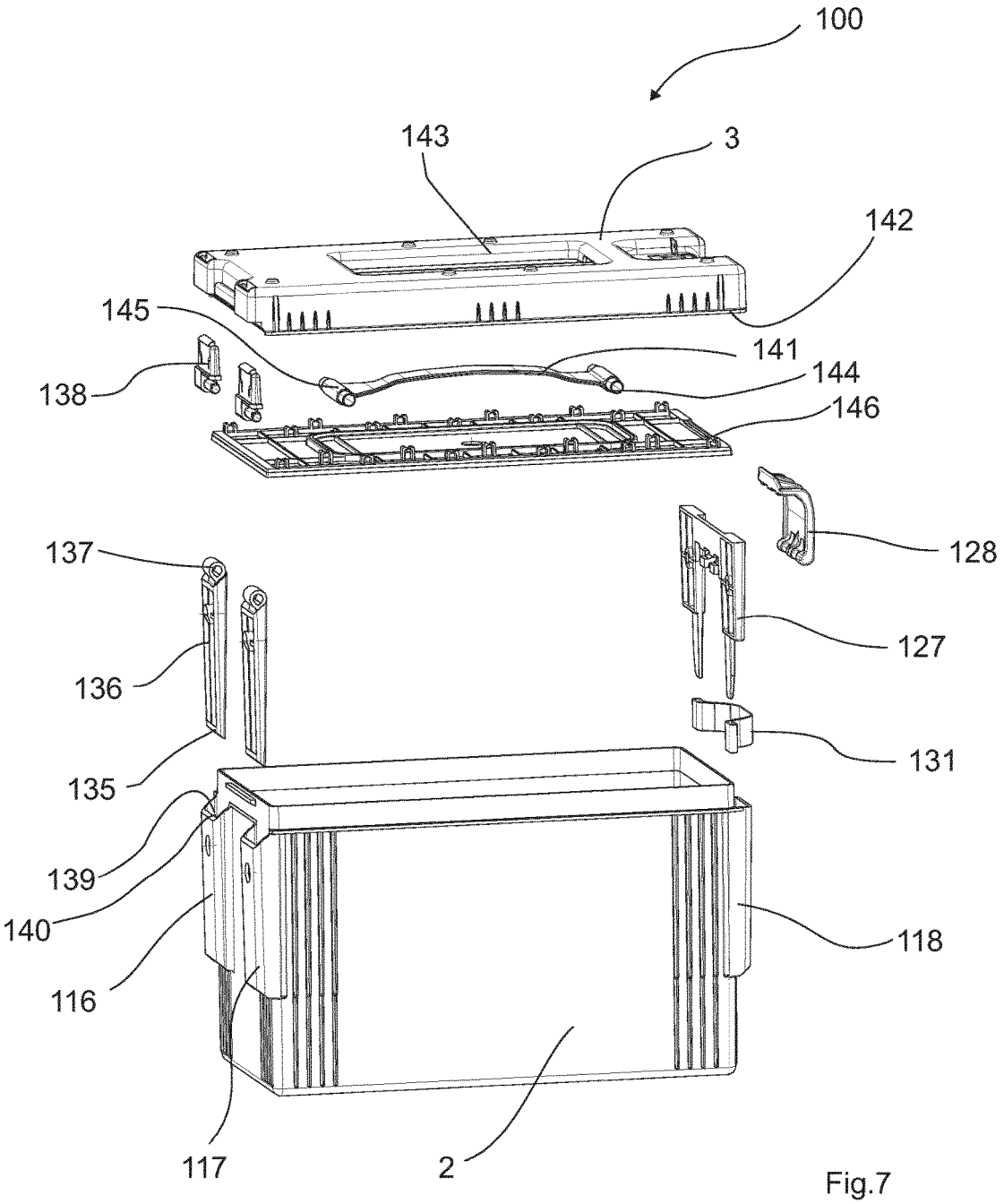
FIG. 7 is an exploded view of the container shown in FIGS. 5 and 6.

FIG. 6 is a perspective view of the container 100, showing the back end 130 of the container 100, and the opposing reinforcement elements 118, 119, covering the corners of the casing 2. The reinforcement elements 118, 119 may define a volume, where the volume may be open from the upper periphery 133 of the reinforcement elements 118, 119, allowing access to the volume from the upper periphery 133. The container 100 may be provided with a first hinge element 136, that is adapted to extend into the volume of the reinforcement element 118, where a lower end of the hinge element 136 (not shown) is adapted to reside inside the volume, and the upper end 137 is adapted to extend above the upper periphery 133 and provide a rotational coupling to the top part 3. Thus the top part 3 may be opened and closed by a rotational movement where the front end of the top part 3 may be fixed using the clasp 128 shown in FIG. 5 and the back part of the top part 3 may be rotationally coupled to the casing part 2, via the first hinge element 136. Thus, when the clasp is in its open position the front end of the top part 3 may be lifted in a direction from the casing part 2, where the back end of the top part 3 maintains its rotational coupling with the casing via the hinge element. The top part 3 may either be adapted to have an integrated second hinge element 138, that may be moulded into the top part 3 or have a second hinge element 138 that is releasably attached to the top part 3, as shown in FIG. 7. The hinge elements 136, 138, may be adapted to transmit loads from the top part 3 to the casing part 2, when load is placed on top of the container 100.

FIG. 7 is an exploded view of the container shown in FIGS. 5 and 6, showing the separate elements of the container 100. The casing part 2, is provided with the reinforcement elements 117, 118, 119, that define a volume between the casing 2 and the inner surface of the reinforcement element 117, 118, 119. The first hinge elements 136 have a first end 135 and a second end 137 where the first end is adapted to slide into the volume 139 of the reinforcement element via an opening 140, allowing the second end 137 to extend from inside the volume and provide a rotational coupling with the second hinge element 138.

The first latching mechanism 127 may be inserted into the reinforcement elements 116 and 117 on the front end of the casing 2, as well as the front handle 131. Thus, the first latching mechanism 127 and the front handle 131 may be introduced into the volume of the reinforcement elements from the upper periphery of the reinforcement elements 116, 117, where the clasp 128 is rotationally coupled to the first latching mechanism 127.

The top part 3, may be provided with an upper handle 141 that is adapted to extend from the lower side 142 of the top part and into the handle compartment 143 on the upper side of the top part 3. The upper handle 141 may be provided with end members 144, 145, which may be positioned in corresponding receiving elements in the top part 3, ensuring that end members 144, 145 are securely attached to the top part 3, allowing the container 100 to be carried during use. The lower side 142 of the top part 3 may be provided with a reinforcement plate 146, that provides an increased rigidity to the top part 3 and is capable of being releasably mounted on the lower side, and thereby providing a fastening mechanism for the handle, so that the ends 144, 145 of the handle are pressed between the upper surface of the reinforcement plate 146 and the lower side 142 of the top part. The upper handle 141 may be adapted to be flexible, so that when the handle is being used, it extends from within the compartment 143, while it retracts into the compartment 143 when not in use. The person skilled in the art will realize on basis of the above, that a different type of handle may be provided in the top part 3.

The top part 3, may be provided with second hinge members 138, that may be releasable attached to the back end of the top part 3, where the second hinge members are adapted to be coupled to the first hinge members of the casing 2.

Figure 8:
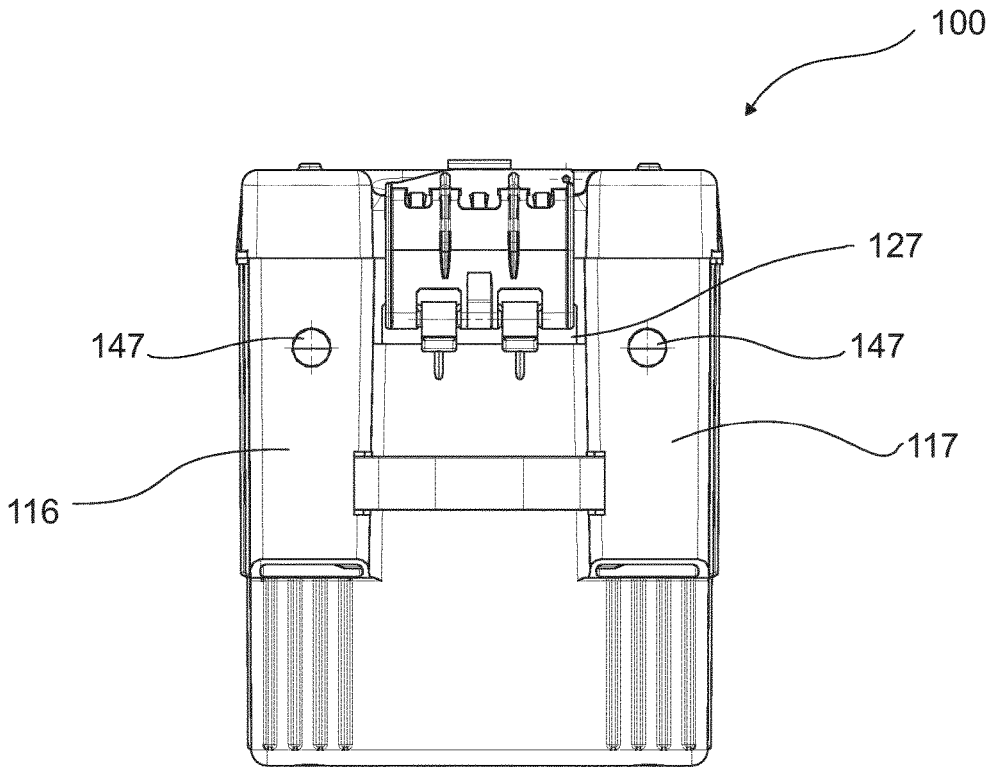
FIG. 8 is an end view the container shown in FIG. 5.

FIG. 8 is an end view the container shown in FIG. 5, where the reinforcement elements 116, 117 are provided with a fastening mechanism 147, that allows the first latching mechanism 127 to be locked into the volume of the reinforcement elements. The fastening mechanism 147 may be an opening where the first latching mechanism has an opposing protrusion that is adapted to extend into the opening, ensuring that the latch mechanism 127 is securely fastened to the casing 2, and preventing that the latch mechanism 127 is capable of moving in a vertical direction upwards or downwards, when the fastening mechanism is engaged. Thus, the latching mechanism 127 may be clicked into place and securely fastened to the casing 2.

Figure 9:
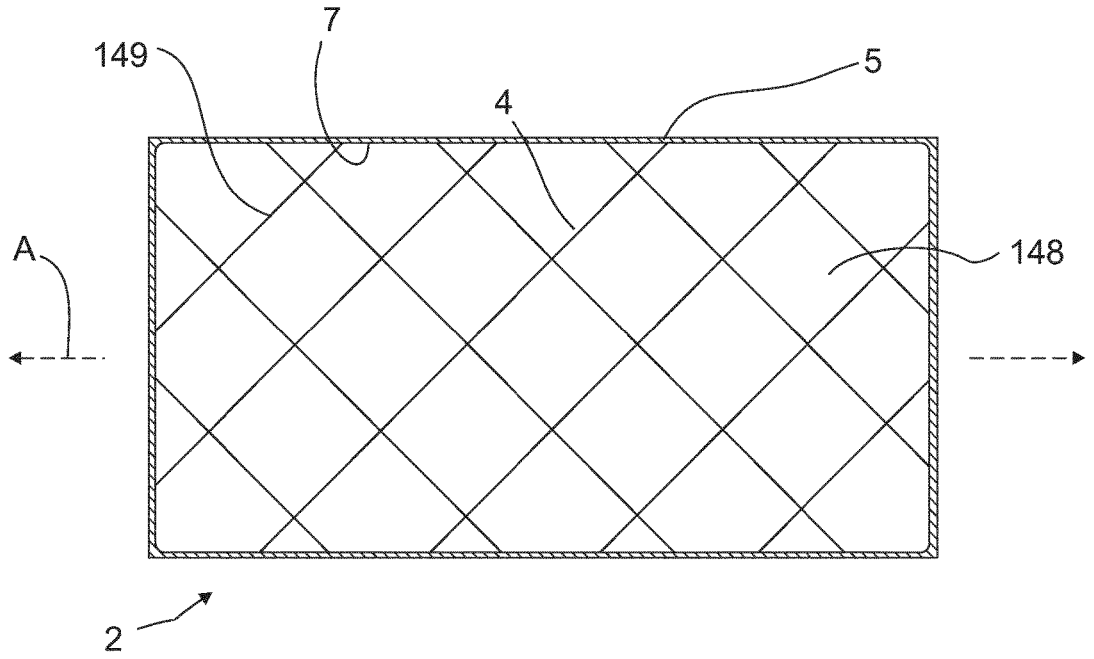
FIG. 9 is a top view of the inner surface of the bottom of a casing part 2 in accordance with the invention.

FIG. 9 is a top view of the inner surface 148 of the bottom of a container in accordance with the invention, where the primary part 5 of the casing defines the inner periphery 7 of the compartment 4 of the casing part 2. The inner surface 148 of the bottom defines a similar surface as the bottom 51 shown in FIG. 4. In this embodiment the inner surface 148 may be provided with a plurality of reinforcement beams 149 that may extend diagonally across the inner surface, and may be arranged substantially orthogonal to each other, at approximately 45° from the longitudinal axis A of the casing 2 and −45° from the longitudinal axis A of the casing 2. The reinforcement beams may provide an increased rigidity in the bottom of the container, and thereby reducing the risk that a load provided by the payload of the container 100 may damage or distort the bottom part during normal use and/or if the casing is dropped.

The person skilled in the art will realize that elements shown in the embodiment in FIGS. 1-4 and the elements shown in FIGS. 5-9 that differ from each other may be easily be replaced and implemented in either embodiment. Thus, the person skilled in the art will have no problem in replacing one element with a corresponding element or adding the features that are only shown in one embodiment to the container shown in alternative embodiments.

The invention claimed is:

1. An ammunition container of thermoplastic material comprising:

a primary, integrally molded part defining a rigid compartment for holding ammunition, where the primary part comprises:

four side walls defining an inner periphery of a sidewall boundary of the compartment and an outer periphery of the sidewall boundary of the compartment, wherein respective ones of the four sidewalls are connected to one another at respective ones of four corners of the primary part, a rectangular base arranged at a lower end of the four side walls defining a lower boundary of the compartment, where an upper end of the four side walls is arranged to provide access to the compartment allowing ammunition to be loaded into the compartment, a secondary part comprising:

at least one hollow reinforcement element provided at or near each of the four corners of the primary part, the reinforcement elements defining a reinforcement element outer periphery of the ammunition container, wherein the reinforcement element is integrally molded with the primary part and where the reinforcement element comprises at least one collapsible impact zone adapted to absorb an external impact to the secondary part and to transmit excess forces of the impact from the reinforcement element to the primary part, wherein the outer periphery of the sidewall boundary and the reinforcement element outer periphery together form a complete lateral outer periphery of the primary element, wherein the ammunition container is provided with a substantially flat, lid having four corners corresponding to the four corners of the primary part, that is adapted to selectively prevent access to the compartment, wherein the lid is provided with integrally molded, hollow cooperative top reinforcement elements that extends the reinforcement elements of the secondary part, from a lowermost end of the lid to the uppermost end of the lid, providing at least one second collapsible impact zone and providing horizontal and/or vertical load support from the upper end of the lid and to the lower end of the lid.

2. An ammunition container according to claim 1 where the at least one reinforcement element is adapted to provide horizontal and/or vertical load support to the primary part.

3. An ammunition container according to claim 1 wherein the at least one reinforcement element extends from the lower end of the four side walls to the upper end of the four side walls.

4. An ammunition container for according to claim 1 wherein a first end of the at least one reinforcement element is attached to a first area of the primary part and a second end of the at least one reinforcement element is attached to a second area of the primary part that is distant to the first area along a length of the primary part.

5. An ammunition container according to claim 1 wherein a first area of the primary part is arranged on an end side wall of four side walls of the primary part and a second area of the primary part is arranged on a longitudinal side wall of the four side walls of the primary part.

6. An ammunition container according to claim 1 wherein the collapsible impact zone of the at least one reinforcement element is elevated away from the side wall outer periphery, so that an overlapping area of the impact zone is mechanically independent from an exposed area of the outer periphery of the sidewall boundary.

7. An ammunition container according to claim 1 wherein the at least one collapsible impact zone is arranged to overlap a transitional area of the four side walls where a longitudinal side wall of the four side walls joins an end side wall of the four side walls, where the longitudinal side wall joins the rectangular base of the primary part and/or where the rectangular base joins the end side wall.

8. An ammunition container according to claim 1 wherein the upper end of the four side walls is provided with a flange extending along the upper end of the four side walls.

9. An ammunition container according to claim 1 wherein the at least one reinforcement element extends from the upper end of the four side walls and towards the lower end of the four side walls and terminating before the at least one reinforcement element it reaches the lower end of the four side walls.

10. An ammunition container according to claim 9 where the four side walls is provided with a reinforcement beam that extends from a lower end of the at least one reinforcement element to the lower end of the four side walls.

11. An ammunition container according to claim 1 wherein the rectangular base is provided with a plurality of diagonal reinforcement beams.

12. An ammunition container according to claim 1 wherein the at least one reinforcement element is provided with a handle.

13. An ammunition container for according to claim 1 wherein the at least one reinforcement element defines a volume between the outer periphery of the side wall boundary of the compartment and an inner boundary of the at least one reinforcement element.

* * * * *